US012577842B2

(12) United States Patent
Artursson et al.

(10) Patent No.: US 12,577,842 B2
(45) Date of Patent: Mar. 17, 2026

(54) METHOD AND SYSTEM FOR MEASURING VOLUME OF A DRILL CORE SAMPLE

(71) Applicant: Minalyze AB, Sävedalen (SE)

(72) Inventors: Mikael Artursson, Northbridge (AU); Angus Philip Anstruther Tod, Como (AU)

(73) Assignee: Minalyze AB, Savedalen (SE)

( * ) Notice: Subject to any disclaimer, the term of this patent is extended or adjusted under 35 U.S.C. 154(b) by 383 days.

(21) Appl. No.: 18/018,367

(22) PCT Filed: Jul. 28, 2021

(86) PCT No.: PCT/EP2021/071117
§ 371 (c)(1),
(2) Date: Jan. 27, 2023

(87) PCT Pub. No.: WO2022/023404
PCT Pub. Date: Feb. 3, 2022

(65) Prior Publication Data

US 2023/0287750 A1 Sep. 14, 2023

(30) Foreign Application Priority Data

Jul. 31, 2020 (AU) ..... 2020902701

(51) Int. Cl.
*E21B 25/00* (2006.01)

(52) U.S. Cl.
CPC ..... *E21B 25/005* (2013.01)

(58) Field of Classification Search
CPC ..... E21B 25/005
USPC ..... 382/109
See application file for complete search history.

(56) References Cited

U.S. PATENT DOCUMENTS

| | | | | |
|---|---|---|---|---|
| 2002/0149585 | A1 | 10/2002 | Kacyra et al. | |
| 2009/0080705 | A1 | 3/2009 | Orpen | |
| 2015/0062300 | A1 | 3/2015 | Li et al. | |
| 2019/0107520 | A1* | 4/2019 | Artursson | G01N 1/08 |

FOREIGN PATENT DOCUMENTS

| | | | |
|---|---|---|---|
| CN | 109030305 | A | 12/2018 |
| WO | 2005116392 | A1 | 12/2005 |
| WO | 2007102129 | A2 | 9/2007 |
| WO | 2011146014 | A1 | 11/2011 |
| WO | 2012069036 | A1 | 5/2012 |

(Continued)

OTHER PUBLICATIONS

NPL : 2010-2023.*

(Continued)

*Primary Examiner* — Quang N Vo
(74) *Attorney, Agent, or Firm* — Ballard Spahr LLP

(57) ABSTRACT

A method and system for determining the volume of a drill core sample, wherein the method comprises the steps of providing a reference surface of a core tray adapted to carry at least one drill core sample, placing a drill core sample in the core tray, scanning the core tray with an electromagnetic 3D scanner to obtain a sample surface, and computing the volume of the drill core sample by comparing the sample surface with the reference surface. Scanning the sample will provide accurate and repeatable measurements even for drill core samples with non-cylindrical segments.

17 Claims, 5 Drawing Sheets

(56) References Cited

FOREIGN PATENT DOCUMENTS

| | | | |
|---|---|---|---|
| WO | 2017155450 | A1 | 9/2017 |
| WO | 2022023404 | A1 | 2/2022 |

OTHER PUBLICATIONS

NPL: Results Publication Date Range: Aug. 13, 1985 to Aug. 7, 2025.*

International Search Report issued by the Australian Patent Office on Aug. 31, 2020, in corresponding Australian Patent Application No. 2020902701 (20 Pages).

Arthursson, Mikael, "Minalyze New Discovery Program Industry Consultation and Knowledge Transfer Workshop," Dec. 10, 2018, 45 pps., Retrieved from the Internet: URL:https://smi.uq.edu.au/files/43635/Decl 8KTW Minalyze GSQ Workshop.pdf [retrieved on-Nov. 11, 2021].

Sjoqvist, A.S.L. et al., "An innovative optical and chemical drill core scanner", Scientific Drilling, vol. 19, May 29, 2015, pp. 13-16, DOI: 10.5194/sd-19-13-2015.

Notification of Transmittal of the International Search Report and the Written Opinion of the International Searching Authority, dated Nov. 19, 2021, issued in International Application No. PCT/EP2021/071117, 15 pps.

* cited by examiner

METHOD AND SYSTEM FOR MEASURING VOLUME OF A DRILL CORE SAMPLE

TECHNICAL FIELD OF THE INVENTION

The invention relates to a method and system for measuring the volume of a drill core sample.

BACKGROUND OF THE INVENTION

In the field of mining, drilling and exploration of natural resources samples of material are extracted from the ground at depths and locations of interest. With the purpose of further studying and analyzing the samples at suitable location above ground. A common method of extracting material samples includes extracting drill core samples from a drill hole, the drill core samples being substantially cylindrical in their shape consisting of a solid or porous material. Once extracted, the drill core samples are placed in a drill core tray to facilitate transportation and handling of the cores. The drill core tray is most commonly a rectangular tray with grooves of a rectangular or cylindrical cross-section, each groove being suitably dimensioned to securely hold a drill core sample. A drill core tray can hold multiple drill core samples and the cores are usually placed in sequence in the trays after extraction depth, extraction site and the type of the extracted material. The subsequent analysis of the extracted drill core samples can include measurements for determining the volume of the drill core sample, the mass of the drill core sample, the density of the drill core or even the material composition of drill core. The result of such drill core sample measurements can be used to determine the properties of the geological formation from which the sample was extracted. For example, the density of a drill core sample may be indicative of the material composition of the sample.

Previous solutions for determining the volume of a drill core sample, or a section of a drill core sample, includes manually measuring or estimating the length and width of the drill core sample and calculating the volume by assuming a cylindrical shape, using a caliper or a ruler. Alternatively, the volume of a drill core sample can be determined by the water displacement method, although such solutions are labor intensive. After determining the volume, the density can be determined by weighing the drill core sample and dividing the measured weight with the measured volume. Furthermore, hydrostatic weighing has been demonstrated for drill core samples for the purpose of determining the density. Hydrostatic weighing for determining the density utilizes Archimedes Principle and involves first weighing a sample in air and then weighing the sample submerged in water. The difference in sample weight between the air and water measurement is equal to the weight of the water displaced by the submerged sample. As the density of water is known, the volume of the displaced water can also be calculated, allowing the density of the drill core sample to be calculated from the sample weight in air and the sample weight in water.

A problem with existing solutions is that the established methods for measuring volume or density introduce considerable measurement errors and offers poor repeatability. Especially for volume measurements of drill core samples which deviate from the expected cylindrical shape. Depending on the quality or composition of the extracted material, sections of the drill core sample might be naturally or mechanically broken during the drilling and extraction or subsequent handling process, thus presenting itself as rubble or gravel instead of the expected cylindrical drill core sample shape. For such drill core samples, segments with an essentially cylindrical shape are routinely measured and the volume calculated, while the volume of segments with rubble, gravel or any non-cylindrical geometry are manually and often inaccurately approximated. Achieving an accurate volume measurement of a fragmented section of a fragmented drill core sample is essential for calculating the density of the sample or approximating the original length of the fractured segment. Heavily fragmented drill core samples are also unsuitable for any type of volume measurement involving water submerging as the samples may be too porous and dissolve partially or completely during the process.

SUMMARY OF THE INVENTION

In view of the shortcomings of the existing solutions there is a need for an improved method for measuring the volume of a drill core sample. Hence, it is an object of the present invention to provide a method for measuring the volume of a drill core sample in a way which is both accurate and repeatable, regardless if the drill core sample is approximately cylindrical or heavily fragmented.

According to a first aspect of the present invention, this and other objects are achieved by a method for measuring the volume of a drill core sample, comprising providing a reference surface of a core tray adapted to carry at least one drill core sample, placing a drill core sample in the core tray, scanning the core tray, with an electromagnetic 3D scanner, to obtain a sample surface, and computing the volume of the drill core sample by comparing the sample surface with the reference surface.

The invention is based on the realization that an accurate and repeatable measurement of the volume of a drill core sample is achieved by scanning the core tray and thereby obtaining a sample surface. A drill core sample may comprise fractures, rubble, partly or entirely pulverized segments and will thus in general deviate in its shape from the expected cylindrical shape. Scanning the sample will provide accurate and repeatable measurements even for drill core samples with non-cylindrical segments. To this end, an electromagnetic 3D scanner capable of creating a geometrical representation of the drill core sample, the sample surface, is used. As the drill core sample is placed in a core tray, the sample surface obtained from scanning may further comprise a geometrical surface representation of at least a part of the core tray, which must be considered when computing the volume of only the drill core sample. By additionally providing a reference surface which represents the drill core tray the sample surface and the reference surface can be compared to compute the volume of the drill core sample. The reference surface represents the surface of an empty core tray and the sample surface obtained by scanning represents the surface of the core tray and a drill core sample placed thereon. The reference surface may represent a surface of the core tray on which the drill core rests when the sample surface is obtained. When comparing the reference and sample surface, the difference between the two will represent the shape of the drill core sample. Thus, the volume of the drill core sample can be computed by computing the volume of the difference between the reference surface and the sample surface.

The reference and sample surface may each be a three-dimensional surface which does not enclose a volume. The reference and sample surface may be non-closed surfaces such as surfaces with a boundary (or edge). That is, the reference surface or the sample surfaces do not on their own define a volume. The sample surface and reference surface may be referred to as a sample and reference topography (relief topography), elevation map or height map. A topographic map is an example of a surface with a boundary which taken alone does not describe a volume.

Computing the volume of the drill core sample by comparing the sample surface with the reference surface may comprise determining a volume which is defined by the difference between the sample surface and the reference surface wherein the volume is indicative of or equal to the volume of the drill core. It is understood that by comparing a reference surface representing a core tray with a sample surface representing the core tray with drill core samples provided on the core tray, the volume of the drill core may be computed using one of many alternative methods. For example, a number of volume elements (e.g. voxels) may be added so as to compensate for any difference between the surfaces wherein the sum of the volume elements is indicative or equal to the volume of the drill core. As another example, each area where there is a difference between the two surfaces may be assigned a finite volume being the product of the area and the average distance between the surfaces for that area, wherein the sum of the finite volumes is indicative or equal to the volume of the drill core.

The sample surface and the reference surface may extend substantially in a XY-plane with each surface comprising a topography represented in the Z-axis perpendicular to the XY-plane. For example, each XY-coordinate may be associated with a Z-value indicating a deviation from the XY-plane. The extension of the sample surface and reference surface may be a projection of each surface onto the XY-plane. For example, the projection of a surface may be linear projection along the Z-axis onto the XY-plane. The extension of a surface may thereby be represented as a 2D shape in the XY-plane wherein each portion of the 2D shape is associated with a corresponding portion of the surface.

The sample surface and the reference surface may comprise an equal extension in the XY-plane. If, for example, the sample surface and the reference surface are acquired by a same scanner and/or scanning procedure it may be expected that the extension in XY-plane is substantially the same for the two surfaces. In some implementations the extension in the XY-plane of the reference and sample surface may be different, for instance the sample surface may have a smaller extension in the XY-plane than the reference surface or vice versa. To facilitate comparison of the sample and reference surface when there is a difference in XY-plane extension a common area in the XY-plane of the two surfaces may be identified, whereby at least one of the surfaces is cropped to the XY-extension of the common surface. The XY-extension of the smaller surface may e.g. be encompassed by the XY extension of the larger surface, accordingly the larger surface may be cropped to the XY-extension of the smaller surface. Alternatively, the smaller surface is complimented with a surface outside the common area to obtain a corresponding XY-extension of the two surfaces, e.g. the complimented surface is equal to the surface outside the common area of the larger surface. As a further alternative, the step of comparing the surfaces is performed only in common area of the two surfaces with any surface lying outside the common XY area of interest is neglected. Accordingly, each Z-value at each XY-coordinate of the sample surface has a corresponding, potentially different, Z-value at a corresponding XY-coordinate of the reference surface.

It is noted that the process of obtaining a volume based on a difference between two surfaces is not novel per se. For example, Chinese patent application no. 201910123799, discloses determination of a volume of material in an excavator bucket. However, the present invention provides a novel implementation of such volume determination, with specific advantages in the field of drill core analysis.

The reference surface may be acquired by scanning the core tray with the scanner.

Scanning a core tray with the electromagnetic 3D scanner allows facilitated provision of a reference surface. The individual properties of a core tray may thus be considered when calculating the volume of a drill core sample. A core tray may feature dents, fractures, or other signs of wear from previous usages or even mud and dirt from previous drill core samples. By scanning the core tray to obtain the reference surface signs of wear or dirt are included in the reference surface and will thus correctly be excluded from the volume of the drill core sample.

The volume of the drill core sample may be determined by integrating a difference between the sample surface and the reference surface.

Integration will sum up the volume of all infinitesimal or finite volume element differences between the reference surface and the sample surface, resulting in the volume of the drill core sample. Integration may be of an obtained 3D geometry or volume representing the differences and thereby the drill core sample. The reference and sample surface may each be a topographic representation, or height map, and integration may be carried out to sum up the separation between the two topographies, e.g. in essentially one direction. In some implementations, the reference surface and sample surface are aligned (e.g. by aligning one or two or more reference points for each surface) prior to determining the difference between the two surfaces.

The method may further comprise identifying at least one cylindrical segment of the drill core sample, and calculating a void volume formed between the cylindrical segment(s) and a bottom surface of the core tray, wherein computing the volume of the drill core sample comprises removing the void volume A drill core sample may comprise a cylindrical segment wherein the expected cylindrical shape from drill core extraction has been maintained. A cylindrically shaped segment may indicate that the particular segment is rigid and unfractured. A cylindrical segment of the drill core sample is expected to maintain its shape once placed on the bottom surface of the core tray and may create an empty void volume between the cylindrical segment and the bottom surface of the core tray. As opposed to finely distributed rubble which would be stacked on the core tray bottom surface. As an example, a cylindrical drill core sample placed on a flat and horizontal core tray bottom surface will feature one void volume on each side of the cylinder, each void volume having the shape of a ramp with a radius of curvature equal to that of the cylindrical segment. In other words, the void volume for a cylindrical segment is the difference between two volumes. The first volume being that of a cylinder with a radius and length equal to that of the cylindrical segment of the drill core sample. The second volume being the volume resulting from the difference between the sample surface and the reference surface. As the cylindrical segments are rigid bodies it would be inaccurate to assume that the volume enclosed by the top surface (i.e. the surface perceived by an observer located above the core tray) of a cylindrical segment, lying down on a core tray bottom surface, and the core tray bottom surface is entirely occupied by the drill core sample. The correct assumption is that the volume defined by the top surface of a cylindrical segment of a drill core sample and the bottom surface of the core tray comprises the drill core sample and a void volume. Calculating and removing a void volume thus yields more accurate volume measurements for cylindrical segments of the drill core sample.

In some applications, a drill core sample block is placed in a core tray together with a drill core sample to separate the drill core sample from a different drill core sample, to better contain the drill core sample or to present information regarding the drill core sample wherein the information is provided on the drill core sample block. Such a drill core sample block, being a component adapted for reference or storage, does not form part of the volume of the drill core sample. Nevertheless, a drill core sample block may be included in a sample surface obtained by scanning a core tray containing thereon a drill core sample and a drill core sample block.

To avoid this problem, the method may include identifying a drill core sample block surface in the sample surface, and excluding the drill core sample block in the sample surface during the computing of the drill core sample volume.

By identifying the drill core sample block it can be excluded during computing of the drill core sample volume such that it does not affect the volume measurement of the drill core sample. Excluding the drill core sample block may comprise subtracting a predetermined drill core sample block volume from the computed drill core sample volume.

In some implementations excluding the drill core sample block comprises replacing the drill core sample block surface in the sample surface with a corresponding portion of the reference surface. With such a replacement a corrected sample surface may be obtained. The corrected sample surface and the reference surface may then be used for computing the volume of the drill core sample as described in other parts of the application. The drill core sample block may also be masked out so it is not part of either of the reference surface or sample surface.

The sample and reference surface may be stored as three-dimensional point cloud models and/or three-dimensional polygon mesh models. These formats are suitable for representing the reference surface or sample surface while computing the volume of the drill core sample. A three-dimensional polygon mesh model may be created from a three-dimensional point cloud model or vice versa.

The step of scanning may be performed by moving a detector of the electromagnetic 3D scanner relative to the core tray. By moving a detector of the electromagnetic 3D scanner relative to the core tray a wider scanning area may be achieved, as the field of view of the detector may be swept over an area. Alternatively or additionally, moving the detector relative to the core tray may facilitate more accurate scanning of the sample and/or reference surface as the detector may view the core tray from different angles and/or distances. For example, moving the detector along the entire length of a core tray may yield a scan of the entire core tray.

According to a second aspect of the invention there is provided a system for determining a volume of a drill core sample. The system comprises a core tray, adapted to carry at least one drill core sample, a scanning device adapted to measure a surface, and a control unit. The control unit being adapted to receive a reference surface of a core tray, control the scanning device to scan the core tray, with a drill core sample provided thereon, to receive a sample surface, and compute the volume of the drill core sample by comparing the sample surface with the reference surface.

According to a third aspect of the invention there is provided a computer program product comprising code for performing, when run on a computer device, the steps of obtaining a reference surface of a core tray, controlling a scanning device to scan the core tray with a drill core sample provided thereon, to obtain a sample surface and computing the volume of the drill core sample by comparing the sample surface with the reference surface.

The invention according to the second and third aspect features the same or equivalent embodiments and benefits as the invention according to the first aspect. Further, any functions described in relation to the method, may have corresponding structural features in the system or code for performing such functions in the computer program product.

BRIEF DESCRIPTION OF THE DRAWINGS

These and other aspects of the present invention will now be described in more detail, with reference to the appended drawings showing exemplary embodiments of the present invention, wherein.

DETAILED DESCRIPTION

In the following detailed description, some embodiments of the present invention will be described. However, it is to be understood that features of the different embodiments are exchangeable between the embodiments and may be combined in different ways, unless anything else is specifically indicated. Even though in the following description, numerous details are set forth to provide a more thorough understanding of the present invention, it will be apparent to one skilled in the art that the present invention may be practiced without these details. In other instances, well known constructions or functions are not described in detail, so as not to obscure the present invention.

Figure 1:
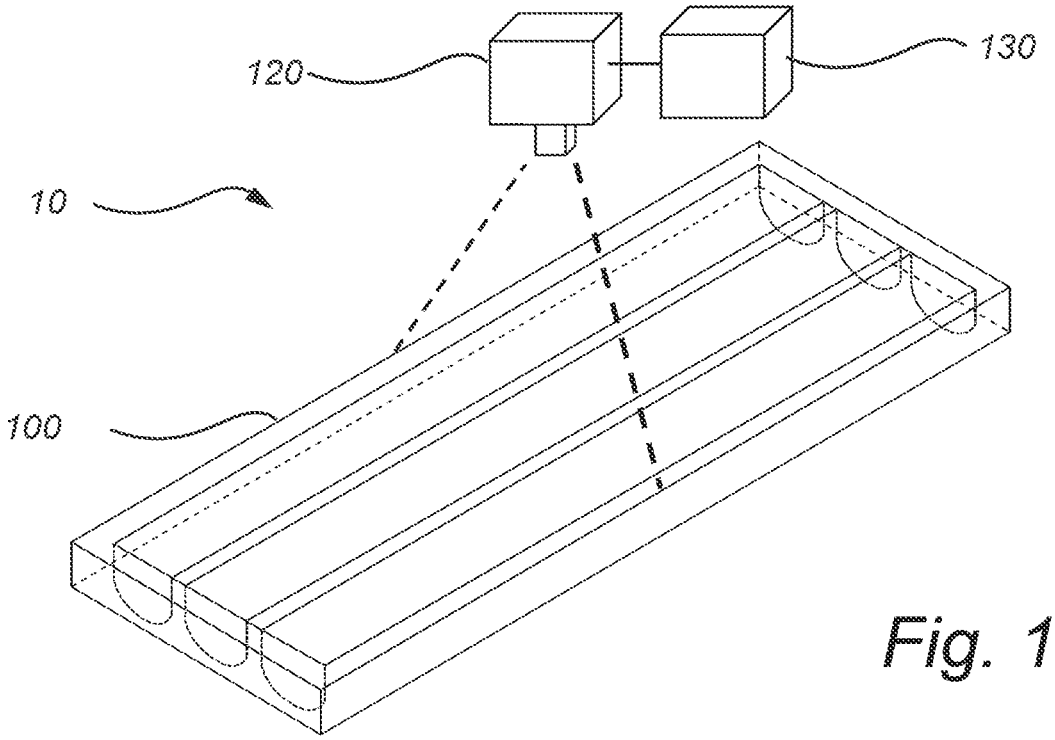
FIG. 1 illustrates a system for measuring the volume of a drill core sample according to an embodiment of the invention.

In FIG. 1 there is depicted a system 10 for measuring the volume of a drill core sample 110. The system comprises a core tray 100 adapted to carry at least one drill core sample, a scanning device 120 adapted to acquire a 3D topographical surface of an object placed below the scanning device, and a control unit 130. The control unit 130 is adapted to control the scanning device 120 to scan the core tray 100, with a drill core sample provided thereon, to obtain a sample surface. The control unit 130 is further configured to compute the volume of said drill core sample 110 by comparing this sample surface with a reference surface of the core tray. This process will be described in further detail below.

Figure 2:
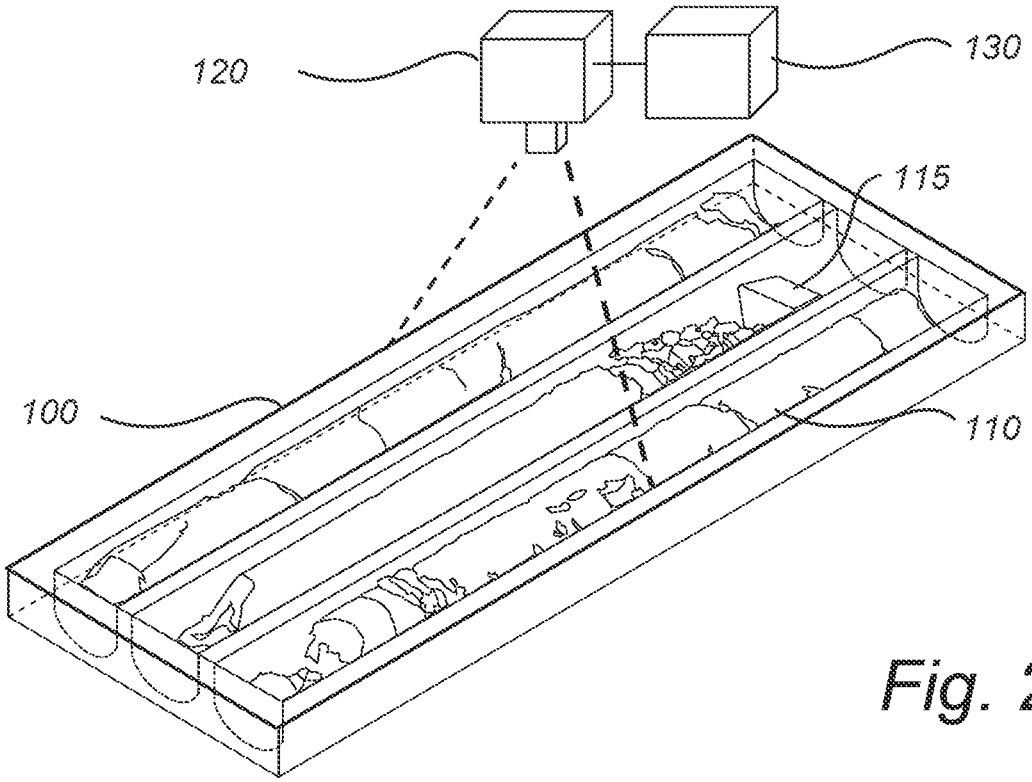
FIG. 2 illustrates the system in FIG. 1, wherein a drill core sample is provided in the core tray.

The core tray 100 may be provided with at least one indentation, or groove 102, adapted to contain a drill core sample 110 (see FIG. 2). The core tray 100 may be any conventional drill core tray 100 customary used for storage and transportation of drill core samples. The grooves 102 of the core tray 100 exemplified in FIG. 1 are provided with a rounded (e.g. cylindrical) bottom surface onto which a drill core sample may be placed. Although any arbitrary shape of the bottom surface of the core tray 100 is possible. A cylindrical bottom surface in the core tray 100 which matches the expected cylindrical profile of a drill core sample has the benefit that the bottom surface may feature a large area of contact with the drill core sample, providing the drill core sample with support which may prevent the core from falling apart during handling or transportation.

The electromagnetic 3D scanner (or scanning device) 120 may be any electromagnetic scanner 120 capable of measuring a distance to a set of points, and to aggregate multiple such distance measurements to form a 3D topography or surface. For example, the scanner 120 may be a RADAR scanner, a laser scanner or a LIDAR scanner. The scanner may also be an optical device employing illumination in the visual or non-visible spectrum, in which case a stereo imaging system may be used to measure distance.

The electromagnetic 3D scanner 120 may comprise a transmitter and a detector of electromagnetic radiation, and configured to determine a distance based on reflected radiation. The detector and the transmitter may constitute individual devices or be included in a same device. In the case of a camera, or stereo-camera, being used as a scanner 120 a detector (image sensor) may collect enough information such that a surface can be obtained, without a transmitter. In the case of a RADAR scanner the transmitter transmits a RADAR signal while a detector receives the scattered RADAR signal. The transmitter and detector may be a same RADAR-antenna or two different antennas.

A suitable scanning device, arranged to provide the topography of drill core samples in a tray is disclosed in WO 2017/155450, hereby incorporated by reference.

The control unit 130 is connected to control the scanner 120, e.g. control its movement in relation to the core tray 120. As the scanner 120 or its detector is moved and acquires data representing the 3D surfaces in its field of view, the control unit 130 may be configured to assemble composite surfaces of e.g. a complete core tray 100 or a drill core sample, which otherwise would have been too large to be seen from a single stationary position.

Moreover, the electromagnetic 3D scanner 120 may receive electromagnetic radiation which does not penetrate into the drill core(s) or the core tray. The electromagnetic 3D scanner may only receive radiation which is reflected from the surface of the drill cores and/or the core tray.

In contrast to other less beneficial solutions, the electromagnetic 3D scanner 120 of present implementations may not record X-ray radiation or any equivalent radiation which by means of transmission through or diffraction from the internal structures of the drill cores (or core tray) comprise information regarding the internal structure of the drill cores (or the core tray). The electromagnetic 3D scanner 120 may be configured to view the drill core samples from a fixed viewpoint. Alternatively or additionally, the electromagnetic 3D scanner is configured to move along a line, curve or plane provided on one side of the drill core samples. For example, the electromagnetic 3D scanner 120 may view the drill core samples (and the core tray) from the above. This has the benefit of allowing the electromagnetic 3D scanner 120 to be placed on a single side of the drill core(s) and the sample tray while still accurately determining the volume of the drill cores. Accordingly, it is not necessary place an X-ray detector plate or equivalent on the far side of the drill core(s) and the core tray as is necessary for performing X-ray analysis or CT-scanning (which further necessitates rotation of the radiation source and the detector plate around the sample) of drill cores.

Other less beneficial solutions involve capturing a single 2D image (e.g. using a camera) of a drill core provided next to a reference symbol, e.g. a ruler or object of known dimensions, so as to enable determining the dimensions of features of the drill core by analyzing the single 2D image. While this solution may offer accurate determination of drill core features in the same plane as the reference symbol (e.g. the length of a complete drill core) the solution cannot accurately analyze fractured or irregularly shaped drill cores.

With further reference to FIG. 2 the placement of drill core samples 110 in the grooves 102 of the core tray 100 is illustrated. The drill core samples 110 are placed in the grooves 102 and are at least partially exposed to the electromagnetic 3D scanner 120. Parts of the drill core sample 110 may be placed in separate grooves of the core tray 100. For example, the part of the drill core sample 110 placed in a groove is associated with an extraction depth interval, indicating between which depths that particular drill core sample 110 was extracted. As mentioned in the above, and illustrated in FIG. 2, the drill core sample 100 may be heavily fractured or be partially or entirely turned into rubble. Some segments 112 of the drill core sample 110 may still be of the expected cylindrical shape while other segments 114 of the drill core sample 110 may deviate, with various extents, from the expected cylindrical shape.

As seen in FIG. 2 a drill core sample block 115 may also be placed alongside the drill core sample 110 in the core tray 100. The drill core sample block 115 may be used for containing a particularly heavily fragment segment of the drill core sample 110. Additionally or alternatively, the drill core sample block 115 may be used for providing reference information regarding the drill core sample 110. A drill core sample block 115 may separate a first part of a drill core sample from a second part of the drill core sample, and indicate information (type of material, extraction depth range, date, etc.) related to each part.

Figure 3:
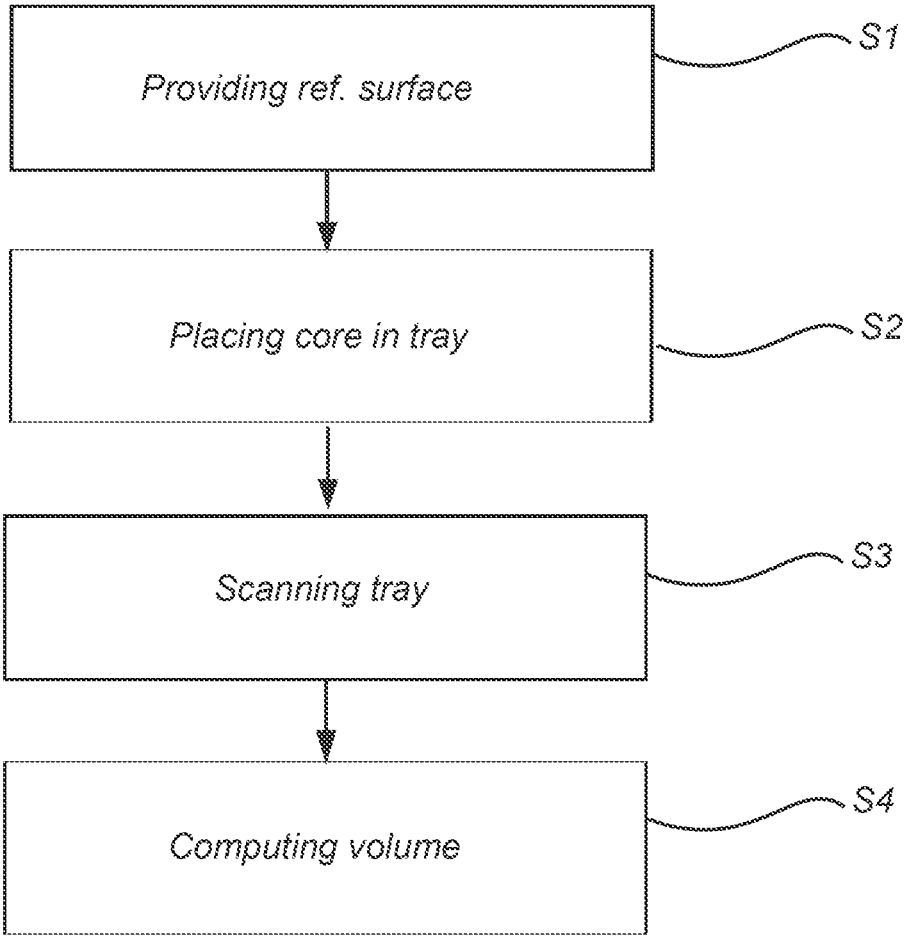
FIG. 3 is a flow chart describing a method for measuring the volume of a drill core according to an embodiment of the present invention.
Figure 4A:
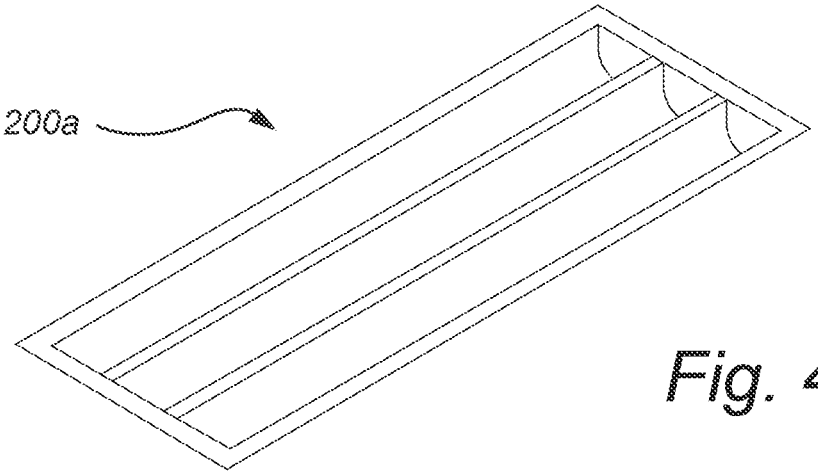
FIG. 4*a* is an illustrative representation of a reference surface.
Figure 4B:
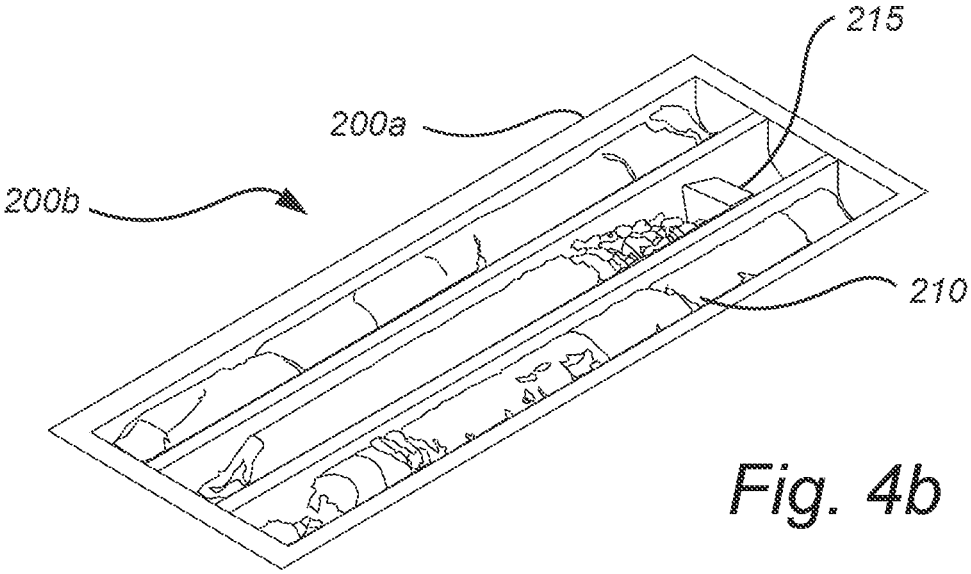
FIG. 4*b* is an illustrative representation of a sample surface.
Figure 4C:
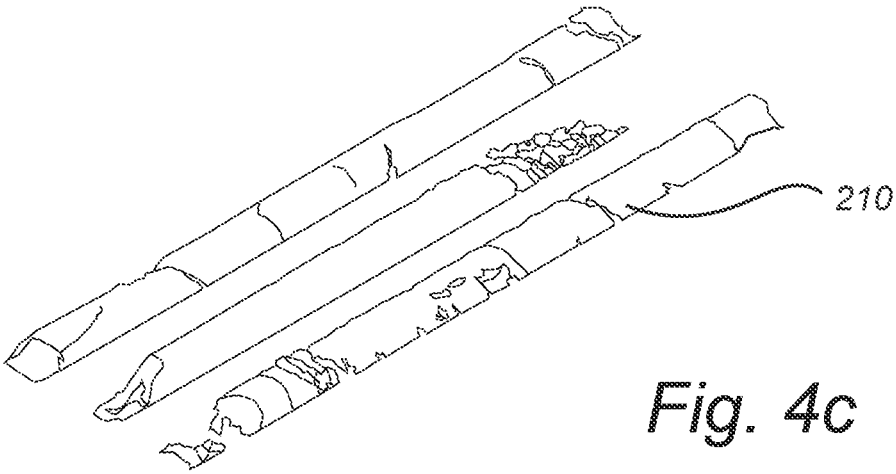
FIG. 4*c* is an illustrative representation of a drill core sample volume.

A method for measuring the volume of the drill core sample 110 using the apparatus in FIGS. 1-2 will now be described with reference to the flow chart in FIG. 3 as well as FIG. 4*a-c* illustrating a reference surface 200*a*, a sample surface 200*b* and a drill core sample volume 210.

In step S1, a reference surface 200*a* (see FIG. 4*a*) of the core tray 115 is provided. The reference surface 200*a* may be a surface comprised in a complete 3D model of the core tray (such as a CAD-design schematic), a 3D model of a surface of the core tray, a set of equations describing the full shape or a surface of the core tray or any other suitable representation of the 3D shape or a topographical surface of the core tray. The reference surface 200*a* in FIG. 4*a* is a 3D representation of a (topographical) surface of the core tray.

In step S2, one or several drill core sample(s) 110 is/are placed in the groove(s) 102 of the drill core tray 100. For the present invention, it is sufficient that the drill core sample is placed in an essentially identical, replica or duplicate variant of the core tray for which the reference surface 200*a* was provided. For example, the reference surface 200*a* provided for a core tray may be associated with a certain manufactured core tray model while the core tray into which the drill core sample is placed is a core tray of that certain core tray model. As previously mentioned, it may provide even more accurate measurements if the reference surface 200*a* is of the exact same core tray, should it deviate from a more general type-specific reference surface 200*a*.

Following step S2, the method continues in step S3 which comprises scanning the core tray, which is holding the drill core sample, with the electromagnetic 3D scanner 120 to obtain a sample surface 200*b* (see FIG. 4*b*). The sample surface 200*b* may be a 3D topographical surface obtained by scanning the drill core sample provided in the core tray.

In embodiments of the present invention providing a reference surface 200*a* of a core tray comprises scanning the core tray with an electromagnetic 3D scanner to obtain the reference surface 200*a*. Obtaining a reference surface 200*a* with scanning may occur in a similar fashion as obtaining a sample surface 200*b* with scanning. For instance, the same 3D scanner may be used in the same configuration. However, it is appreciated that scanning the core tray to obtain a reference surface 200*a* may be done with a different scanner. It is conceivable that scanning the core tray to obtain a reference surface 200*a* and the core tray with drill core samples to obtain a sample surface 200*b* can be done in any order. For instance, an empty core tray is scanned first, to obtain a reference surface 200*a*, then a drill core sample is placed in the tray before the scanning the drill core tray to obtain a sample surface 200*a*. Alternatively, the drill core tray may first be scanned with drill core samples provided thereon to obtain a sample surface 200*b*, and then the drill core sample is removed before scanning an empty core tray to obtain a reference surface 200*a*.

In step S4 the volume of the drill core sample is computed by comparing the sample surface 200*b* with the reference surface 200*a*.

The difference between the two surfaces may define a volume which is referred to as a "drill core sample volume" 210. For instance, in finding the difference, the reference surface 200*a* may be aligned with the sample surface 200*b* whereby the reference surface 200*a* is removed from the sample surface 200*b* and the volume of the remaining surface with respect to a reference plane is computed. The remaining surface after removing the reference surface 200*a* may be the surface of only the drill core sample, the drill core sample surface 210. Computing the volume of the drill core sample may comprise computing the volume of the drill core sample surface 210.

When the reference surface 200*a* and the sample surface 200*b* are both 3D surfaces, the volume of the drill core sample may be computed by aligning these surfaces and integrating a distance formed between the surfaces. The integration may for example be any form of numerical integration wherein the difference between the two surfaces 200*a*, 200*b* is represented as a plurality of finite volume elements, the total volume being the sum of the volume elements.

Alternatively, a reference plane located somewhere below the 3D surfaces may be introduced, and two volumes may be computed by integrating distances between each of the two topographical surfaces and this reference plane, respectively. Finally, the volume of the drill core sample can be determined by subtracting one volume from the other. This approach requires more processing power, but has the advantage that it does not require an alignment of the two topographical surfaces.

A drill core sample may obscure empty spaces between an underside of the drill core sample and the bottom surface of the core tray. Some drill core samples will fit tightly into a core tray, leaving empty spaces between the underside and the bottom of the core tray which are not perceivable by a scanner, regardless of where the scanner is located in relation to the core tray with the drill core samples. These empty obscured spaces, referred to as void volumes, may not be perceived by the scanner but can be calculated by assuming that certain segments of the drill core sample are in fact cylindrical segments. Maintaining their cylindrical shape even in the obscured spaces. By identifying a cylindrical segment an associated void volume is extracted as the empty space obstructed from viewing by the scanner, between the cylindrical segment and the core tray. For instance, the reference surface 200*a* may be utilized to extract the shape of a core tray groove. From the shape of a core tray groove a cylinder matching the cylindrical segment of a drill core sample may be imaginarily placed in the core tray groove. From such an imaginary setup, it is possible to derive the void volumes not seen by a scanner located at some viewing position relative to the core tray groove. The void volume for a cylindrical segment may be zero, for instance if the drill core sample is provided on core tray with a concave bottom surface with a radius of curvature which corresponds to the radius of the cylindrical segment.

Figure 5:
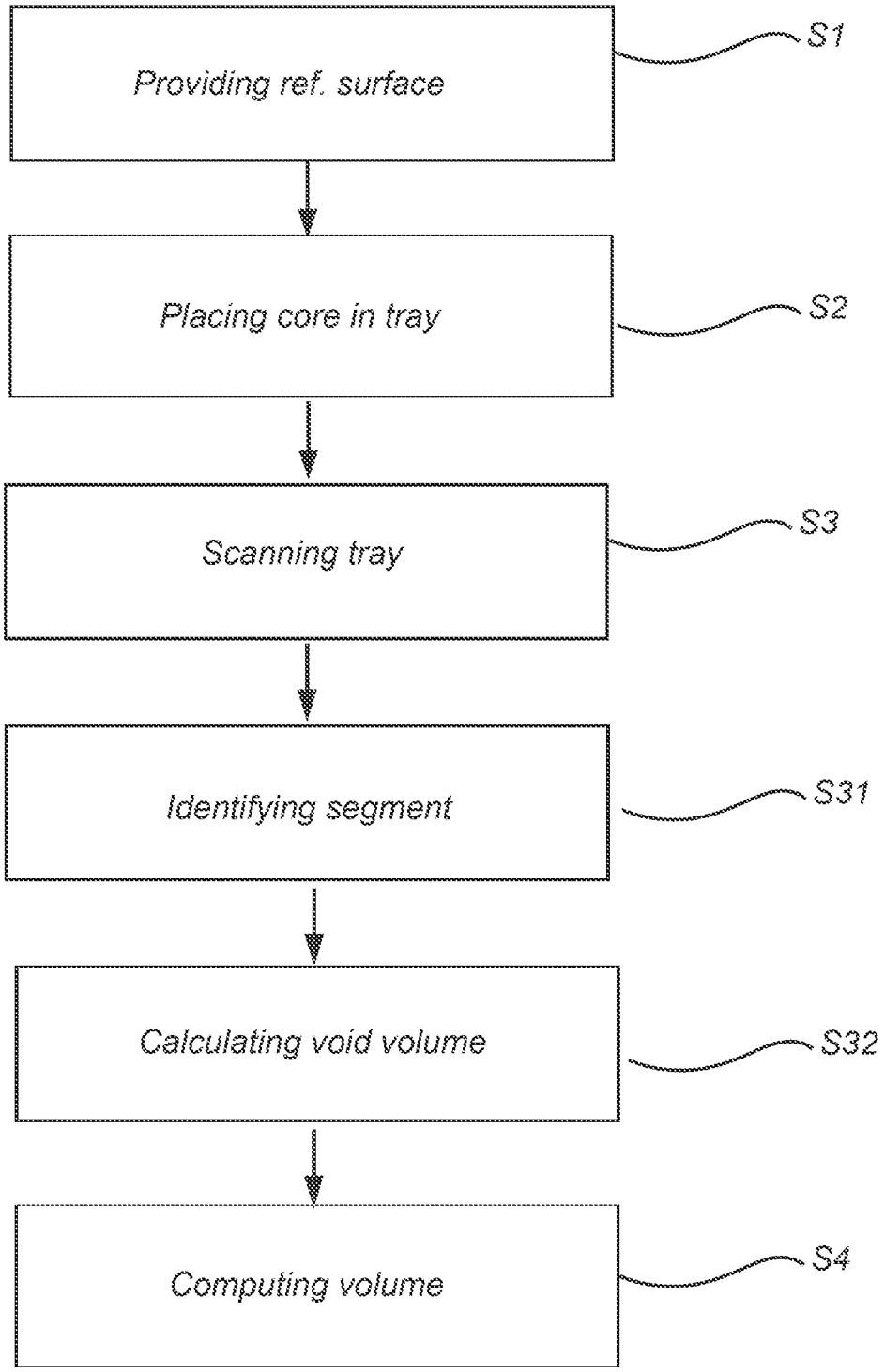
FIG. 5 is a flow chart of a method for measuring the volume of a drill core tray according to a further embodiment of the present invention.

In the embodiment shown in FIG. 5, the method comprises the optional steps S31 and S32. In step S31, at least one cylindrical segment 112 of the drill core sample 110 is identified. For example, if a surface of the drill core sample is determined to be cylindrical, with sufficiently few fractures or geometrical deviations from a cylindrical surface, an associated segment of the drill core sample is identified as a cylindrical segment. Then, in step S32 a void volume formed between the cylindrical segment and a bottom surface of the core tray is calculated.

The calculated void volume may then be used in S4 for computing the volume of the drill core sample. The void volume is removed from the volume extracted from the difference between the sample surface 200*b* and the reference surface 200*a*. Void volume calculation and removal is especially useful when the drill core samples, lying in the core tray, are only scanned from essentially one direction, e.g. the drill core sample is scanned only from right above the drill core tray lying on a horizontal surface. A drill core sample may comprise multiple cylindrical segments, in which case a void volume is calculated removed for each segment. A longer cylindrical segment will be associated with a larger void volume compared to a shorter, but otherwise equivalent, cylindrical segment.

In some applications, a drill core sample block 115 is provided and placed together with the drill cores sample 110 in the core tray 115. In this case, the sample surface 200*b* resulting from scanning the core tray in step S3 may comprise at least a part of the surface of a drill core sample block 115, referred to as a "drill core sample block surface" 215. The drill core sample block will in general contribute to the volume defined by the difference between the reference surface 200*a* and the sample surface 200*b*. However, the volume of the drill core sample block 115 is preferably ignored when computing the volume of the drill core sample.

Figure 6:
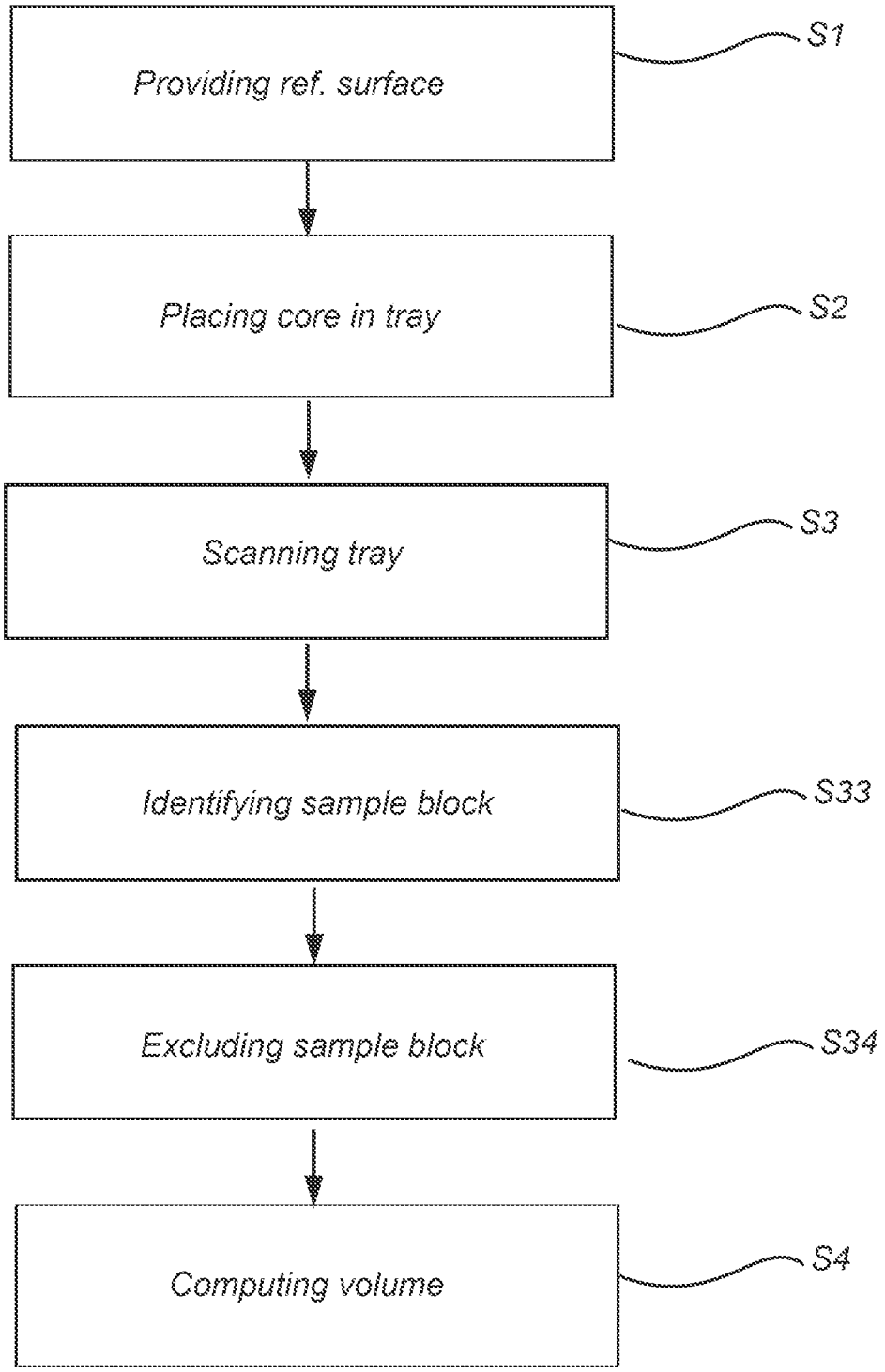
FIG. 6 is a flow chart of a method for measuring the volume of a drill core sample according to yet another embodiment of the present invention.

To handle this situation, the method may further include steps S33 and S34, as shown in FIG. 6. After having obtained a reference surface 200*b* in step S3 the method continues to step S33 and identifies a drill core sample block surface 215. For instance, identifying the drill core sample block surface 215 may comprise identifying a characteristic drill core sample block shape in the sample surface 200*b*. An identified drill core sample block may be associated with a size, volume and/or position of the drill core sample block on the core tray. In step S34 the drill core sample block surface 215 is then excluded from the sample surface 200*b* before/while computing the volume of the drill core sample in step S4. Excluding the drill core sample block surface 215 in step S34 may comprise indicating an exclusion zone or boundary in the sample surface 200*b* and/or the reference surface 200*a* indicating that any volume originating from the exclusion zone during computing of the drill core sample volume should be ignored and not be counted towards the drill core sample volume. Alternatively, excluding the drill core sample block surface 215 may comprise providing a predetermined drill core sample block volume. The volume of the drill core sample together with the drill core sample block is computed in accordance with other embodiments of the invention and excluding the drill core sample block is implemented as a final step, by removing the predetermined drill core sample block volume from the computed drill core sample and drill core sample block volume.

Alternatively, excluding the drill core sample block surface 215 in step S34 comprises replacing the drill core sample block surface 215 in the sample surface 200*b* with a corresponding portion of the reference surface 200*a*. In this way, the drill core sample block is excluded before the reference surface 200*a* and the sample surface 200*b* are compared. Replacing the drill core sample block surface 215 with a corresponding portion of the reference surface means that there will be no difference between the sample surface 200*b* and the reference surface 200*a* at the location of the drill core sample block, which will exclude the drill core sample block volume from being added towards the drill core sample volume.

The surfaces or volumes 200*a*, 200*b*, 215, 210 depicted in FIG. 4*a-c* may be obtained, converted to or stored as a three-dimensional point cloud and/or a three-dimensional mesh model. For instance, the electromagnetic 3D scanner may be adapted to obtain a point cloud representing the sample surface 200*b* and/or the reference surface 200*a*. To better represent the surfaces or volumes the point cloud could be decimated, interpolated and/or converted into a mesh model of the surfaces or volumes.

Step S3 of scanning the core tray 115 with a drill core sample 110 provided thereon to obtain a sample surface 200*b* may comprise moving a detector of the electromagnetic 3D scanner relative to said core tray. As the detector may have a limited field of view, moving the detector, e.g. sweeping it along the length of a drill core sample, and continuously or at discrete intervals obtaining a detector reading of the scene may provide a composite surface which covers the entire sample. Alternatively or additionally, the detector may be moved so as to observe a same point of the drill core sample, the core tray and/or the drill core sample block from different distances, from different angles or at different times. Multiple observations of a same point may then be combined and averaged so as to generate more detailed, and/or accurate, surface representations of the drill core sample, the core tray and/or the drill core sample block.

The skilled person in the art realizes that the present invention by no means is limited to the embodiments described above. The features of the described embodiments may be combined in different ways, and many modifications and variations are possible within the scope of the appended claims. In the claims, any reference signs placed between parentheses shall not be construed as limiting to the claim. The word "comprising" does not exclude the presence of other elements or steps than those listed in the claim. The word "a" or "an" preceding an element does not exclude the presence of a plurality of such elements.

The invention claimed is:

1. A method for measuring a volume of a drill core sample, said method comprising the steps of:
- providing a reference surface representing an empty core tray, said core tray being adapted to carry at least one drill core sample;
- placing a drill core sample in the core tray;
- scanning said core tray when the drill core sample is in the core tray, with an electromagnetic 3D scanner, to obtain a sample surface, wherein the reference surface and the sample surface are topological surfaces; and
- computing the volume of said drill core sample by comparing said sample surface with said reference surface.

2. The method according to claim 1, wherein providing a reference surface of said core tray comprises scanning said core tray with said electromagnetic 3D scanner to obtain said reference surface.

3. The method according to claim 1, wherein computing the volume of said drill core sample comprises integrating a difference between said sample surface and said reference surface.

4. The method according to claim 1 further comprising the steps of:
- identifying at least one cylindrical segment of said drill core sample; and
- calculating a void volume formed between said at least one cylindrical segment and a bottom surface of said core tray,
- wherein computing the volume of said drill core sample comprises removing said void volume.

5. The method according to claim 1, wherein a drill core sample block is provided together with the drill core sample on said core tray, and wherein computing the volume of said drill core sample comprises:
- identifying said drill core sample block in said sample surface; and
- excluding said drill core sample block in said sample surface during said computing of the drill core sample volume.

6. The method according to claim 5, wherein excluding said drill core sample block comprises replacing the drill core sample block surface in said sample surface with a corresponding portion of said reference surface.

7. The method according to claim 1, wherein the reference surface and the sample surface are stored as three-dimensional point cloud models and/or three-dimensional polygon mesh models.

8. The method according to claim 1, wherein the scanning is performed by moving a detector of the electromagnetic 3D scanner relative to said core tray.

9. The method of claim 1, wherein the core tray has a rounded surface configured to receive the core sample thereon.

10. A system for determining the volume of a drill core sample comprising:
- a core tray adapted to carry at least one drill core sample,
- a scanning device adapted to measure a surface, and
- a control unit adapted to:
  - receive a reference surface representing an empty core tray;
  - control said scanning device to scan said core tray, with a drill core sample provided thereon, to receive a sample surface, wherein the reference surface and the sample surface are topographical surfaces; and compute the volume of said drill core sample by comparing said sample surface with said reference surface.

11. The system of claim 10, wherein the control unit is adapted to integrate a difference between said sample surface and said reference surface to compute the volume of said drill core sample.

12. The system of claim 10, wherein the control unit is adapted to:

identify at least one cylindrical segment of said drill core sample;

calculate a void volume formed between said at least one cylindrical segment and a bottom surface of said core tray; and remove said void volume during computing of the volume of the drill core sample.

13. The system of claim 10, wherein the control unit is adapted to:

identify a drill core sample block in said sample surface; and exclude said drill core sample block in said sample surface during computing of the volume of the drill core sample volume.

14. The system of claim 13, wherein the control unit is further adapted to:

replace the drill core sample block in said sample surface with a corresponding portion of said reference surface.

15. The system of claim 10, wherein the control unit is configured to store the reference surface and the sample surface as three-dimensional point cloud models and/or three-dimensional polygon mesh models.

16. The system of claim 10, wherein the scanning device is configured to move relative to said core tray during scanning of said core tray.

17. A non-transitory computer-readable medium comprising instructions that, when executed by a computing device, cause the computing device to perform the steps of:

obtaining a reference surface representing an empty core tray;

controlling a scanning device to scan said core tray, with a drill core sample provided thereon, to obtain a sample surface, wherein the reference surface and the sample surface are topographical surfaces; and computing the volume of said drill core sample by comparing said sample surface with said reference surface.

* * * * *